US009091253B2

(12) United States Patent
Stein et al.

(10) Patent No.: US 9,091,253 B2
(45) Date of Patent: Jul. 28, 2015

(54) FLUID WORKING MACHINES AND METHODS

(75) Inventors: Uwe Bernhard Pascal Stein, Edinburgh (GB); Niall James Caldwell, Edinburgh (GB)

(73) Assignee: ARTEMIS INTELLIGENT POWER LIMITED, Loanhead (GB)

( * ) Notice: Subject to any disclaimer, the term of this patent is extended or adjusted under 35 U.S.C. 154(b) by 542 days.

(21) Appl. No.: 13/000,103

(22) PCT Filed: Jun. 22, 2009

(86) PCT No.: PCT/GB2009/050714
§ 371 (c)(1),
(2), (4) Date: May 20, 2011

(87) PCT Pub. No.: WO2009/153605
PCT Pub. Date: Dec. 23, 2009

(65) Prior Publication Data

US 2011/0226342 A1 Sep. 22, 2011

(30) Foreign Application Priority Data

Jun. 20, 2008 (GB) ..... 0811385.4

(51) Int. Cl.
*F04B 35/04* (2006.01)
*F04B 7/00* (2006.01)
(Continued)

(52) U.S. Cl.
CPC ..... *F04B 7/0076* (2013.01); *F01B 15/06* (2013.01); *F01B 25/10* (2013.01); *F04B 7/0057* (2013.01); *F04B 49/24* (2013.01)

(58) Field of Classification Search
CPC ..... F04B 35/045; F04B 2203/0401; F04B 2203/0402; F01L 11/02; F01L 11/06; F01L 21/02; F01L 21/04; F01L 25/08
USPC ..... 417/442, 446, 457, 482, 484, 506, 520; 137/2; 92/163; 91/227, 234, 243, 248
See application file for complete search history.

(56) References Cited

U.S. PATENT DOCUMENTS 760,809 A 5/1904 Schmidt
1,594,082 A 7/1926 Walker
(Continued)

FOREIGN PATENT DOCUMENTS

CN 1973133 5/2007
EP 1319836 6/2003
(Continued)

OTHER PUBLICATIONS

International Search Report for PCT/GB2009/050714, mailed Oct. 20, 2009.
(Continued)

*Primary Examiner* — Devon Kramer
*Assistant Examiner* — Patrick Hamo
(74) *Attorney, Agent, or Firm* — Lowe Hauptman & Ham, LLP

(57) ABSTRACT

A fluid working machine comprises a controller and a working chamber of cyclically varying volume having an electronically controllable primary low pressure valve and a secondary low pressure port associated therewith, each of which is openable and closable in phased relation to cycles of working chamber volume to bring the working chamber into fluid communication with a low pressure manifold. At least the primary low pressure valve is under the active control of the controller to enable the controller to determine the net displacement of fluid by the working chamber on a cycle by cycle basis. The primary low pressure valve and the secondary low pressure port are openable concurrently and in parallel during a portion of at least some cycles of working chamber volume, including at the point in the expansion or contraction stroke where the rate of change of volume of the working chamber is greatest.

21 Claims, 8 Drawing Sheets

(51) Int. Cl.

| | |
|---|---|
| ***F01B 15/06*** | (2006.01) |
| ***F01B 25/10*** | (2006.01) |
| ***F04B 49/24*** | (2006.01) |

(56) References Cited

U.S. PATENT DOCUMENTS

| | | | | |
|---|---|---|---|---|
| 2,187,151 | A * | 1/1940 | Gillen | 417/466 |
| 3,679,328 | A | 7/1972 | Cattanach | |
| 3,679,332 | A * | 7/1972 | Yohpe | 417/503 |
| 4,921,208 | A | 5/1990 | LaMarca | |
| 5,190,446 | A | 3/1993 | Salter et al. | |
| 5,259,738 | A | 11/1993 | Salter et al. | |
| 5,735,582 | A | 4/1998 | Eith et al. | |
| 6,000,417 | A * | 12/1999 | Jacobs | 137/2 |
| 6,530,363 | B1 | 3/2003 | Blass et al. | |
| 6,651,545 | B2 | 11/2003 | Nippert | |
| 6,655,362 | B2 | 12/2003 | Rembold et al. | |
| 2002/0129793 | A1 | 9/2002 | Tokuo et al. | |
| 2003/0132409 | A1 | 7/2003 | Birkelund | |
| 2005/0211224 | A1 | 9/2005 | Inaguma et al. | |
| 2006/0039795 | A1 | 2/2006 | Stein et al. | |
| 2007/0258832 | A1 * | 11/2007 | Caldwell et al. | 417/315 |
| 2010/0243067 | A1 | 9/2010 | Stein et al. | |

FOREIGN PATENT DOCUMENTS

| | | |
|---|---|---|
| EP | 1327810 | 7/2003 |
| EP | 1537333 | 6/2005 |
| EP | 2307720 | 11/2011 |
| FR | 2481757 | 11/1981 |
| GB | 672696 | 5/1952 |
| GB | 0 361 927 | 4/1990 |
| GB | 2276222 | 9/1994 |
| JP | 47-12526 | 6/1972 |
| JP | 5-503335 | 6/1993 |
| JP | 11-343945 | 12/1999 |
| JP | 2000-008997 | 1/2000 |
| JP | 2001-248514 | 9/2001 |
| JP | 2008-069789 | 3/2008 |
| WO | 9105163 | 4/1991 |
| WO | 03/052302 | 6/2003 |
| WO | 2006/067076 | 6/2006 |
| WO | 2006/090174 | 8/2006 |
| WO | 2006/109079 | 10/2006 |
| WO | 2007/088380 | 8/2007 |

OTHER PUBLICATIONS

International Preliminary Report on Patentability for PCT/GB2009-050714 mailed Dec. 21, 2010.

Japanese Office Action for Application No. 2011-514134 mailed Jan. 8, 2013.

Mannesmann Rexroth Corporation, Data Sheet of Mannesmann Rexroth Radial Piston Pump Model R4/Series 2X Fixed Displacement, RA 11 263/03.95, Admitted as of Sep. 2007, Bethlehem, PA, pp. 1-8.

Office Action for corresponding U.S. Appl. No. 13/000,115, dated Jun. 2, 2014.

Poclain Hydraulics S.A., Data Sheet PL Hydraulic Pumps Poclain Hydraulics, Feb. 21, 2006, <www.PoclainHydraulics.com>.

* cited by examiner

FLUID WORKING MACHINES AND METHODS

This application is the U.S. national phase of International Application No. PCT/GB2009/050714 filed 22 Jun. 2009, which designated the U.S. and claims priority to GB Application No. 0811385.4 filed 20 Jun. 2008, the entire contents of each of which are hereby incorporated by reference.

FIELD OF THE INVENTION

The invention relates to the field of fluid working machines, particularly fluid working machines which comprise at least one working chamber of cyclically varying volume, in which the net displacement of fluid through the or each working chamber is regulated by at least one electronically controllable valve, on a cycle by cycle basis, to determine the net throughput of fluid through the or each working chamber.

Some embodiments of the invention relate to a method of supplying fluid to, or receiving fluid from, a working chamber of a fluid working machine. Some embodiments of the invention aim to facilitate the opening of an electronically controllable valve during a motoring cycle of a fluid working machine.

BACKGROUND TO THE INVENTION

Fluid working machines include fluid-driven and/or fluid-driving machines, such as pumps, motors, and machines which can function as either a pump or as a motor in different operating modes.

When a fluid working machine operates as a pump, a low pressure manifold typically acts as a net source of fluid and a high pressure manifold typically acts as a net sink for fluid. When a fluid working machine operates as a motor, a high pressure manifold typically acts as a net source of fluid and a low pressure manifold typically acts as a net sink for fluid. Within this description and the appended claims, the terms "high pressure manifold" and "low pressure manifold" refer to manifolds with higher and lower pressures relative to each other. The pressure difference between the high and low pressure manifolds, and the absolute values of the pressure in the high and low pressure manifolds will depend on the application. For example, the pressure difference may be higher in the case of a pump which is optimised for a high power pumping application than in the case of a pump which is optimised to precisely determine the net displacement of fluid, for example, a pump for dispensing a metered amount of fluid (e.g. a liquid fuel), which may have only a minimal pressure difference between high and low pressure manifolds. A fluid working machine may have more than one low pressure manifold.

Although the invention will be illustrated with reference to applications in which the fluid is a liquid, such as a generally incompressible hydraulic liquid, the fluid could alternatively be a gas.

Fluid working machines are known which comprise a plurality of working chambers of cyclically varying volume, in which the displacement of fluid through the working chambers is regulated by electronically controllable valves, on a cycle by cycle basis and in phased relationship to cycles of working chamber volume, to determine the net throughput of fluid through the machine. For example, EP 0 361 927 disclosed a method of controlling the net throughput of fluid through a multi-chamber pump by opening and/or closing electronically controllable poppet valves, in phased relationship to cycles of working chamber volume, to regulate fluid communication between individual working chambers of the pump and a low pressure manifold. As a result, individual chambers are selectable by a controller, on a cycle by cycle basis, to either displace a predetermined fixed volume of fluid or to undergo an idle cycle with no net displacement of fluid, thereby enabling the net throughput of the pump to be matched dynamically to demand.

EP 0 494 236 developed this principle and included electronically controllable poppet valves which regulate fluid communication between individual working chambers and a high pressure manifold, thereby facilitating the provision of a fluid working machine functioning as either a pump or a motor in alternative operating modes. EP 1 537 333 introduced the possibility of part cycles, allowing individual cycles of individual working chambers to displace any of a plurality of different volumes of fluid to better match demand.

Key factors which determine the performance of fluid working machines of this type include the performance characteristics of the electronically controllable valves. These valves are typically electromagnetically actuated poppet valves, although other valves types could conceivably be employed. Relevant performance characteristics include the speed at which the electronically controllable valves open and close, the pressure difference against which they can open, their operational lifetime and the cross-section of the flow path through the valve whilst open, which limits the throughput of fluid and influences the flow characteristics of fluid into and out of the working chambers. Accordingly, the electronically controllable valves are an expensive and performance limiting component of such fluid working machines and it would be desirable to reduce one or more of the demands made on the electronically controllable valves.

In particular, a significant technical problem, which determines the specification of electronically controllable valves for a particular application, arises when fluid flows into a working chamber of a pump from a low pressure manifold during an expansion stroke of a working chamber. The rate of fluid flow is limited by the cross-section and geometry of the flow path through the poppet valve and the properties of the working fluid. Where the fluid flowing into the working chamber is a liquid, it is subject to cavitation, which increases noise, reduces efficiency by requiring a pressure difference across the poppet valve, and leads to damage to the machine. A different problem applies during the contraction stoke of a working chamber in a motor, when fluid flows out to a low pressure manifold, where an increased pressure drop causes inefficiency, and where the poppet valve may be inadvertently closed causing possible damage to the valve and inadvertent pumping.

This problem has typically been solved by specifying larger electronically controllable valves for higher throughput applications, or applications where superior fluid flow characteristics are required. However, larger electronically controllable valves are more expensive and there can be a trade off in performance characteristics. For example, larger electronically controllable valves may open and close more slowly than smaller valves or use more electrical power, forcing compromises to be made.

Accordingly, some aspects of the invention aim to reduce the performance demands on the electronically controllable valves, to facilitate improved performance or to enable smaller and/or reduced specification electronically controllable valves to be employed than would otherwise be the case to obtain a fluid working machine with specified performance characteristics. Some aspects of the invention also aim to reduce the build up of hot fluid that can occur in the crankcase in radial piston pumps and/or motors.

Further aspects of the invention address problems associated with opening the low pressure valve, which connects a working chamber to a low pressure manifold, in a fluid working motor (such as a fluid working machine which can function only as a motor, or a fluid working machine which can function either as a motor or a pump, in different operating modes). In a motoring cycle, a high pressure valve associated with the working chamber is closed, under the active control of the controller, shortly before the end of the expansion stroke. As the working chamber continues to expand, the pressure of the fluid trapped within the working chamber drops. Typically, the pressure of the fluid trapped within the working chamber will need to drop to close to the low pressure manifold pressure before the low pressure valve can open. However, it can take a significant period of time for the pressure of the fluid trapped within the working chamber to drop to a sufficiently low value, for several reasons. Firstly, the rate of change of working chamber volume decreases towards the end of the expansion stroke in most fluid working machines. Secondly, the variation in pressure of the fluid trapped within the working chamber is not a linear function of the volume of the working chamber, in the case of many commonly used hydraulic fluids. Furthermore, gases which are dissolved within the hydraulic fluid may evaporate, which has the effect of reducing the expected rate of decrease of pressure within the working chamber. This delay can reduce the efficiency of the fluid working motor. Indeed, malfunctions can arise if the pressure within the working chamber does not drop to a sufficiently low value to enable the opening of the low pressure valve, for example on start-up, or when operating in especially high or low temperature conditions.

Accordingly, some aspects of the invention aim to facilitate the opening of a low pressure valve, which regulates communication between the interior of a working chamber and a low pressure manifold, during a motoring cycle of a fluid working machine.

SUMMARY OF THE INVENTION

According to a first aspect of the present invention there is provided a fluid working machine comprising a controller and a working chamber of cyclically varying volume, the working chamber having an electronically controllable primary low pressure valve associated therewith to control the connection of the working chamber to a low pressure manifold, the controller being operable to actively control at least the primary low pressure valve, in phased relationship to cycles of working chamber volume, to determine the net displacement of fluid by the working chamber on a cycle by cycle basis, characterised in that the working chamber further comprises a secondary low pressure port which is openable and closable in phased relationship to the cycles of working chamber volume to connect the working chamber to a low pressure manifold, to enable fluid to flow into or out of the working chamber concurrently through both the primary low pressure valve and the secondary low pressure port, during a portion of at least some cycles of working chamber volume.

By determining the net displacement of fluid by the working chamber on a cycle by cycle basis, we refer to determining the net displacement of fluid by the working chamber, during individual cycles of working chamber volume, from amongst a plurality of possible net displacements of fluid (which may be discrete net displacements and/or selected from a continuous range of net displacements). In order to determine the net displacement of fluid by the working chamber, the controller may actively control a plurality of electronically controllable valves.

The fluid working machine may comprise a plurality of said working chambers. In this case, the controller may be operable to actively control a plurality of electronically controllable valves, comprising at least the primary low pressure valve associated with each of the plurality of said working chambers, in phased relationship to cycles of working chamber volume, to determine the net displacement of each of the said plurality of working chambers on a cycle by cycle basis. Typically, this determines the net throughput of fluid through the fluid working machine as a whole. The controller may be operable to determine the net displacement of fluid by individual working chambers, or groups of working chambers, during individual cycles of working chamber volume.

By "actively control" we refer to enabling the controller to affect the state of an electronically controllable valve, in at least some circumstances, by a control mechanism which consumes power and is not exclusively a passive response, for example, the opening or closing of a valve responsive solely to the pressure difference across a valve. Related terms such as "active control" should be construed accordingly. Nevertheless, the primary low pressure valve, and one or more other electronically controllable valves, where present, are preferably also operable to open or close by passive means. The primary low pressure valve typically opens passively due to the drop in pressure within the working chamber, such as during an intake stroke. For example, the primary low pressure valve, or one or more other electronically controllable valves, where present, may, during at least some cycles, open passively due to a pressure difference and be selectively closable under the active control of the controller during a portion of the cycle.

By "actively control" (and related terms such as "active control") we include the possibilities that the controller is operable to selectively cause an electronically controllable valve to do one or more of open, close, remain open and/or remain closed. The controller may only be able to affect the state of an electronically controllable valve during a portion of a working cycle. For example, the controller may be unable to open the primary low pressure valve against a pressure difference during the majority of a working cycle when pressure within the working chamber is substantial. Typically, the controller actively controls the electronically controllable primary low pressure valve, and one or more other electronically controllable valves where present, by transmitting a control signal either directly to an electronically controllable valve or to an electronically controllable valve driver, such as a semiconductor switch. By transmitting a control signal, we include transmitting a signal which denotes the intended state of an electronically controllable valve (e.g. open or closed) or a pulse which denotes that the state of an electronically controllable valve should be changed (e.g. that the valve should be opened or closed), or a pulse which denotes that the state of an electronically controllable valve should be maintained. The controller may transmit a signal on a continuous basis and stop or change the signal to cause a change in the state of an electronically controllable valve, for example, the electronically controllable primary low pressure valve, or one or more other electronically controllable valves where present, may comprise a normally closed solenoid opened valve which is held open by provision of an electric current and actively closed by switching off the current.

By "in phased relationship to cycles of working chamber volume" we mean that the timing of active control by the controller of the primary low pressure valve, and one or more other electronically controllable valves, where present, is determined with reference to the phase of the volume cycles of the working chamber. Accordingly, the fluid working machine typically comprises working chamber phase determining means, such as a position sensor. For example, where the cycles of working chamber volume are mechanically linked to the rotation of a shaft, the fluid working machine preferably comprises a shaft position sensor, and optionally a shaft speed sensor, and the controller is operable to receive a shaft position signal from the shaft position sensor, and optionally a shaft speed signal from a said shaft speed sensor. In embodiments which comprise a plurality of working chambers, with a phase difference between the volume cycles of different working chambers, the controller will typically be operable to determine the phase of individual working chambers.

In this way, the primary low pressure valve and secondary low pressure port work together to supply fluid into or out of the working chamber, from at least one low pressure manifold, during a portion of at least some cycles of working chamber volume. As a result, the fill or exhaust characteristics of the working chamber are better than would be the case if the working chamber could be brought into fluid connection with one or more low pressure manifolds only by way of the primary low pressure valve. For example, the force acting against the expansion or contraction of the working chamber, due to the pressure difference between the working chamber and the or each low pressure manifold, may be reduced. Where the fluid is a liquid, the improved flow characteristics with the secondary low pressure port can eliminate cavitation while using an electronically controllable primary low pressure valve that would otherwise have had a too small cross-sectional area. This may have the effect of reducing noise and/or improving the efficiency of the fluid working machine and/or increasing the operating life of the machine. The provision of a secondary flow path for fluid during an expansion stroke can particularly improve the performance of the pump at start-up, or in cold conditions, when the hydraulic fluid is at a relatively low temperature and so has a relatively high viscosity.

Preferably, the secondary low pressure port is closed for at least part of each cycle of working chamber volume. Preferably, the primary low pressure valve and the secondary low pressure port are closed concurrently only during selected cycles of working chamber volume which are determined by the controller. For example, the primary low pressure valve may remain open throughout selected cycles of working chamber volume where determined by the controller. Preferably, the primary low pressure valve and the secondary low pressure port are closed concurrently between instances when the primary low pressure valve is open. Typically, at least under some operating conditions, the primary low pressure valve and the secondary low pressure port are closed concurrently between consecutive periods where the primary low pressure valve and the secondary low pressure port are open concurrently.

Typically, the primary low pressure valve and the secondary port are open concurrently during consecutive cycles of working chamber volume. Although the primary low pressure valve and the secondary port may be open concurrently when the fluid-working machine is starting to operate, before a complete cycle of working chamber volume has been completed, the primary low pressure valve and the second port are typically open concurrently during at least some cycles of working chamber volume, and typically at least some consecutive cycles of working chamber volume, after the first cycle of working chamber volume which occurs when the fluid working machine is started.

The at least one working chamber may have a commutator associated therewith to alternately attach the electronically controllable primary low pressure valve to (i) the said low pressure manifold and (ii) a high pressure manifold, for example as disclosed in EP 1 738 077). However, the working chamber typically comprises a high pressure valve to control the connection of the working chamber to a high pressure manifold. The high pressure valve may comprise a pressure operated check valve (e.g. in the case of a pump) or a further electronically controllable valve (e.g. in the case of a motor, or a fluid working machine operable to function either as a pump or a motor), which is preferably under the control of the controller.

Preferably, the controller is operable, in respect of at least some cycles of working chamber volume in which both the primary low pressure valve and the secondary low pressure port are open concurrently, to cause the primary low pressure valve to close under the active control of the controller, to bring the working chamber out of communication with the or each said low pressure manifold, a period of time after the secondary low pressure port closes. In these circumstances, the secondary low pressure port is already closed when the controller may cause the primary low pressure valve to close to bring the working chamber out of communication with the or each said low pressure manifold, and so the end of a period during which the working chamber is in fluid communication with one, or optionally two or more, low pressure manifolds, remains under the control of the controller. This enables the controller to select the net displacement of fluid through the working chamber on a cycle by cycle basis, for example, by selecting the timing of the closure of the primary low pressure valve relative to the phase of cycles of working chamber volume or, for example, by optionally selecting an idle cycle of the working chamber in which there is no net displacement of fluid through the working chamber, perhaps by holding the primary low pressure valve open throughout a cycle (e.g. as disclosed in EP 0 361 927) or keeping the working chamber out of fluid communication with any low pressure manifold throughout a cycle (e.g. as disclosed in WO 2007/088380). Typically, working chamber volume continues to vary cyclically during idle cycles in which there is no net displacement of fluid through the working chamber. Furthermore, the controller can more precisely define the end of the period during which the working chamber is in fluid communication with one, or optionally two or more, low pressure manifolds, than would be the case using a non-electronically controllable valve.

Accordingly, the primary low pressure valve does not require as large a flow path cross-section as would be the case if the secondary low pressure port was not provided. This may allow an electronically controllable valve with a smaller flow path cross-section to be employed than would otherwise be the case to obtain desired performance characteristics. Accordingly, the primary low pressure valve may be selected with increased emphasis on its performance in defining the end of the period during which a working chamber is in fluid communication with one, or optionally two or more, low pressure manifolds, for example, because of its speed of closing, its ability to open against a pressure gradient, its power consumption, or its reliability, than would be the case if the flow path cross-section of the primary low pressure valve was a higher priority.

The primary low pressure valve and secondary low pressure port may each be openable to bring the working chamber into and out of fluid communication with the same low pressure manifold. Alternatively, the primary low pressure valve and secondary low pressure port may each be openable to bring the working chamber into and out of fluid communication with a different low pressure manifold. In this case, the two low pressure manifolds would typically have similar pressures.

It may be that the primary low pressure valve and the secondary low pressure port are only open concurrently during an expansion stroke of the working chamber, for example, where the fluid working machine is operating as a pump. The secondary low pressure port may be openable only during an expansion stroke of the working chamber, but the primary low pressure valve may be optionally closed under the active control of the controller within or just before the beginning of the contraction stroke (bottom dead centre in a piston machine) and openable at the end of the contraction stroke (top dead centre in a piston machine) of the working chamber.

It may be that the primary low pressure valve and the secondary low pressure port are only open concurrently during a contraction stroke of the working chamber, for example, in the case of a fluid working machine operating as a motor, such as a fluid working machine in which the high pressure valve comprises an electronically controllable valve under the active control of the controller. The secondary low pressure port may be openable only during a contraction stroke of the working chamber, but the electronically controllable low pressure valve may be optionally closed under the active control of the controller before the end of the contraction stroke (top dead centre in a piston machine) and openable at or after the end of the contraction stroke (top dead centre in a piston machine).

Preferably, the primary low pressure valve and the secondary low pressure port are both open in use, during at least some cycles of working chamber volume, at the point in an expansion or contraction stroke, as appropriate, where the rate of change of the volume of the working chamber is greatest, as this is the time when the greatest rate of fluid intake or discharge respectively is required. Indeed, as the pressure difference across the primary low pressure valve is proportional to the square of the rate of fluid flow through the primary low pressure valve, it may be sufficient for the primary low pressure valve and the secondary low pressure port to both be open in use during a limited portion of an expansion or contraction stroke, as appropriate. Said limited portion of an expansion or contraction stroke is preferably less than 50%, of the duration of an expansion or contraction stroke, as appropriate, including the point in an expansion or contraction stroke, as appropriate, where the rate of change of the volume of the working chamber is greatest.

The period of time during which both the secondary low pressure port and the primary low pressure valve are open concurrently during selected cycles is preferably less than 90%, and preferably more than 30%, of the duration of a contraction stroke or expansion stroke, as appropriate. This allows scope for variation in the period of time which elapses between closure of the secondary low pressure port and closure of the primary low pressure valve from cycle to cycle, to select different net displacements of fluid during individual cycles of working chamber volume whilst enabling the secondary low pressure port to supply or receive additional fluid for a significant portion of the contraction stroke or expansion stroke.

Where the fluid working machine is functioning as a pump (for example, where the fluid working machine is a pump, or where the fluid working machine is operable to function as either a pump or a motor in alternative operating modes, and is functioning as a pump), it may be that at the beginning of the expansion stroke of a pumping cycle (that is to say, at top dead centre), the primary low pressure valve and the secondary low pressure port are closed concurrently and the secondary low pressure port remains closed for a period of time which is sufficient to cause the pressure within the working chamber to drop below the pressure of the low pressure manifold, such that there is a net pressure differential across the low pressure valve, urging the low pressure valve to open. This pressure reduction occurs because the working chamber is a closed, expanding volume, with the low pressure valve, secondary low pressure port, and high pressure valve, all closed concurrently. The secondary low pressure port then opens after the low pressure valve has opened during at least some (and in some embodiments all) cycles of working chamber volume. This configuration is particularly advantageous where the low pressure valve is a passively opening electronically controllable valve as it reduces the extent to which the low pressure valve must be biased to the open position in order for it to function correctly. In some embodiments, the low pressure valve is not biased to the open position. Thus, the low pressure valve can be opened quickly and reliably while minimising or obviating bias to the open position. It is advantageous to reduce or remove such bias as this biasing resists active closure of the low pressure valve. Preferably, the pressure within the working chamber drops sufficiently to cause cavitation after top dead centre, before the primary low pressure valve or the secondary low pressure port open.

It may be that the primary low pressure valve opens after the secondary low pressure port during at least some cycles of working chamber volume. It may be that the primary low pressure valve opens before the secondary low pressure port during at least some cycles of working chamber volume. In some embodiments, the controller is operable to determine whether the primary low pressure valve opens before or after the secondary low pressure port on a cycle by cycle basis.

Preferably, whichever of the primary low pressure valve and the secondary low pressure port opens first during the said some cycles of working chamber volume opens at a time during the volume cycle of the working chamber when the pressure difference between the working chamber and the low pressure manifold is minimal, for example less than 5% of the maximum design pressure of the working chamber.

The opening and/or closing of the secondary low pressure port may, or may not, be controlled by the controller. The secondary low pressure port may be openable passively, for example, responsive to the pressure in the working chamber being at least a predetermined amount below the pressure in the respective low pressure manifold. Accordingly, the secondary low pressure port may be a pressure operated valve.

In some embodiments, the secondary low pressure port is openable or closable by a secondary electronically controllable valve, the opening or closing or both opening and closing of which is under the active control of the controller, to bring the working chamber into or out of fluid communication with a low pressure manifold by way of the secondary low pressure port. The secondary low pressure port may be openable and closable by a secondary electronically controllable valve which opens passively in use, in response to the pressure in the working chamber being below the pressure in the low pressure manifold. The secondary low pressure port may be openable or closable by a secondary electronically controllable valve which closes passively in use, in response to the pressure in the working chamber being above the pressure in the respective low pressure manifold.

Where the secondary low pressure port is openable or closable by means of a secondary electronically controllable low pressure valve, the primary low pressure valve and the secondary electronically controllable low pressure valve may be selected to each have operating characteristics which are better suited to the roles of last closing and first opening the connection between the working chamber and the or each low pressure manifold, respectively.

The secondary low pressure port may be openable other than by an electronically controllable valve. For example, the secondary low pressure port may be normally-closed but openable responsive to the pressure within the working chamber being a predetermined amount less than the pressure in the low pressure manifold communicating with the secondary low pressure port. Thus, the secondary low pressure port may comprise a normally-closed pressure-openable check valve.

The phase of the opening and closing of the secondary low pressure port may be invariable relative to cycles of working chamber volume, that is to say, the opening and closing of the secondary low pressure port may be phase locked. In the case of a fluid working machine which is operable to function as either a pump or a motor in different operating modes, the opening and closing of the secondary low pressure port is preferably not phase locked. This is because the secondary low pressure port is typically openable during the expansion stroke for a pumping cycle and the contraction stroke for a motoring cycle, but not both.

Where the opening and closing of each secondary low pressure port is phase locked to the expansion and contraction cycle of the working chamber, each secondary low pressure port may be opened and closed by a mechanical arrangement operatively linked to the expansion and contraction cycle of the working chamber.

Where the fluid working machine comprises a rotatable shaft, such as a crankshaft, the opening and closing of the secondary low pressure port may be operatively linked by a mechanical arrangement to the angle of the rotatable shaft. Accordingly, the primary low pressure valve may be openable on a cycle by cycle basis under the active control of the controller, but the opening and closing of the secondary low pressure port may not be variable on a cycle by cycle basis, and may be fixedly phase locked to the expansion and contraction cycle of the working chamber, e.g. by virtue of a mechanical arrangement operatively linked to the angle of a rotatable shaft, where present. The secondary low pressure port may comprise a mechanically actuated valve operated by a pushrod mechanically linked to the expansion and contraction cycles of the working chamber.

The secondary low pressure port may comprise one or more apertures in the working chamber, for example, where the working chamber comprises a hollow piston, the secondary low pressure port may comprise an aperture in the hollow piston, such as an aperture in the base of the hollow piston. The fluid working machine may be operable to bring one or more fluid conducting conduits periodically into alignment with the said one or more apertures to thereby bring the working chamber into fluid communication with a manifold for a period of time, typically in phased relation with, and preferably phase locked to, cycles of working chamber volume. Where the fluid working machine comprises a plurality of said working chambers, a single fluid conducting conduit may periodically align with the apertures associated with a plurality of said working chambers in turn. Typically, the or each fluid conducting conduit is formed in a rotatable member, such as a rotatable shaft, or a rotatable eccentric or shaft having a plurality of lobes, such as a ring cam.

For example, the fluid working machine may be a piston pump, with the working chamber having a volume defined by a cylinder and reciprocating piston, for example, a hollow piston. The fluid working machine may be a radial piston pump in which a cylinder has a base in sliding contact with an eccentric attached to (typically integrated into the surface of) a rotatable crankshaft. Where the fluid working machine comprises a plurality of said working chambers defined by cylinders, each of which has a base in sliding contact with the same eccentric, the eccentric may include one or more fluid conducting conduits adapted to periodically bring an aperture in the base of each cylinder which is in sliding contact with the eccentric into fluid communication with a low pressure manifold in turn, thereby opening the secondary low pressure port associated with each working chamber in turn in phased relation to cycles of working chamber volume to bring each working chamber into, and subsequently out of, fluid communication with the said low pressure manifold. The said low pressure manifold may comprise the crankshaft case of a radial piston pump. The one or more fluid conducting conduits may comprise one or more peripheral slots extending around part of the circumference of the eccentric. Thus, the or each peripheral slot may periodically bring the interior of pistons into fluid communication with fluid within the surrounding crankshaft case in phased relation to cycles of working chamber volume.

Alternatively, the fluid working machine may be an axial piston pump in which the working chamber has a volume defined by a cylinder and reciprocating piston, for example, a hollow piston, driven by and in communication with a wobble plate, wherein the working chamber comprises an aperture which functions as the secondary low pressure port and the wobble plate comprises one or more fluid conducting conduits adapted to periodically bring the said aperture in the base of the cylinder into fluid communication with a low pressure manifold, thereby periodically opening the secondary low pressure port of the working chamber. Where a plurality of said working chambers are provided, more than one of which has a volume defined by a cylinder and reciprocating piston in communication with the same wobble plate, the one or more fluid conducting conduits are preferably arranged to periodically bring the aperture in the base of each said working chamber into fluid communication with a low pressure manifold to thereby open the secondary low pressure port of each said working chamber in turn. The low pressure manifold in communication with the one or more fluid conducting conduits may comprise the crankshaft case of an axial piston pump. The one or more fluid conducting conduits may comprise one or more slots in the surface of the wobble plate arranged to periodically bring the interior of the piston, or each of the said plurality of pistons in turn, into, and subsequently, out of, fluid communication with fluid within the surrounding crankshaft case in phased relation to cycles of working chamber volume.

The working chamber is preferably elongate at its maximum extent and the primary low pressure valve and secondary low pressure port may be provided spaced apart along the length of the working chamber, for example, at or proximate to opposite ends of the working chamber. By "spaced apart along the length" we mean that a vector extending from the primary low pressure valve to the secondary low pressure port has a component parallel to the length of the working chamber and do not mean to imply a limitation that the said vector is necessarily parallel to the axis of the working chamber.

By providing paths for fluid to enter the working chamber at two different locations which are spaced apart along the length of the working chamber, the flow characteristics of fluid flowing into or out of the working chamber are better than would be the case if the primary low pressure valve and the secondary low pressure port were adjacent. Where the working chamber is elongate whilst at maximum extent, the primary low pressure valve and the secondary low pressure port are preferably provided at opposite ends of the working chamber to maximise this effect.

Where the working chamber is a piston-cylinder having a generally fixed end and a moving end (for example, in the case of a radial or axial piston machine), the primary low pressure valve is preferably provided at the fixed end of the cylinder, to minimise movement of the primary low pressure valve. The primary low pressure valve may be coaxial with the cylinder or extend radially from the cylinder at the fixed end of the cylinder. The high pressure valve is typically also provided at the fixed end of the cylinder, typically either coaxially with or extending radially from the low pressure valve. In these arrangements, the secondary low pressure port is preferably provided at the opposite end of the cylinder. This has the advantage of causing an exchange of fluid in all parts of the cylinder on each cycle, reducing hot spots in the fluid around the base of the cylinder. For example, the secondary low pressure port may be coaxial with or extend radially from the cylinder, at the moving end of the cylinder.

The controller is operable to control the opening and/or closing of the primary low pressure valve. Where the high pressure valve comprises an electronically controllable valve, the controller is preferably operable to control the opening and/or closing of the said electronically controllable valve. Where the secondary low pressure port is openable and/or closable by a secondary electronically controllable low pressure valve, the controller is preferably operable to control the opening and/or closing of the secondary electronically controllable low pressure valve.

The controller is preferably operable to control the opening and/or closing of the at least one electronically controllable valve (comprising at least the primary low pressure valve) on a cycle by cycle basis by either, or preferably both, of determining whether or not to open and/or close a specific electronically controllable valve during a specific cycle, and determining the phase of the opening and/or closing of a specific electronically controllable valve relative to a cycle of the volume of the working chamber. By controlling the opening and/or closing of the at least one electronically controllable valve we include the possibility of holding a valve open or closed.

Typically, by controlling the opening and/or closing phase of the at least one electronically controllable valve (comprising at least the primary low pressure valve) on a cycle by cycle basis, the controller is operable to cause the working chamber to displace a volume of fluid selected from a plurality of different selectable volumes, on a cycle by cycle basis. Typically, the plurality of different selectable volumes includes the maximum volume displaceable by an individual working chamber, and no net displacement. No net displacement may be achieved by an idle cycle in which the electronically controllable low pressure valve remains open throughout a cycle of working chamber volume or by sealing the working chamber throughout a cycle of working chamber volume, for example as described in WO 2007/088380. By displacement we refer to the net movement of fluid from the or each low pressure manifold to the (or each) high pressure manifold, or vice versa, and do not refer to any net movement of fluid between low pressure manifolds, or high pressure manifolds, which may occur. The plurality of different selectable volumes preferably also includes at least one volume, and preferably a plurality of volumes (for example, a continuous range of volumes) between no net displacement and the maximum volume displaceable by the working chamber. However, where a plurality of working chambers are provided, the controller may also control groups of working chambers in this manner. The controller typically balances the time averaged net throughput of fluid of one or more working chambers against a received demand signal which may be constant or variable. The fluid working machine is typically used in combination with high and/or low pressure accumulators in communication with the high and/or low pressure manifolds respectively to smooth the pressure or flow of the input and/or output fluid.

The one or more electronically controllable valves (including the electronically controllable primary low pressure valve, and the high pressure valve and/or the secondary electronically controllable valve where provided) are typically face-sealing valves. The one or more electronically controllable valves (including the electronically controllable primary low pressure valve, and the high pressure valve and/or the secondary electronically controllable valve where provided) are typically poppet valves. The one or more electronically controllable valves (including the electronically controllable primary low pressure valve, and the electronically controllable high pressure valve and/or the secondary electronically controllable valve where provided) may be electromagnetically actuated poppet valves. The one or more electronically controllable valves (including the electronically controllable primary low pressure valve, and the electronically controllable high pressure valve and/or the secondary electronically controllable valve where provided) may be solenoid operated poppet valves.

The primary low pressure valve is typically inward opening, toward the working chamber. The high pressure valve is typically outward opening, away from the working chamber.

The fluid working machine may be a pump. The fluid working machine may be a motor. The fluid working machine may be operable to function as either a pump or a motor in alternative operating modes. The fluid working machine may further comprise one or more manifolds in communication with the primary low pressure valve, secondary low pressure port and/or high pressure valve.

In embodiments in which the fluid working machine comprises a plurality of said working chambers, the optional and preferred features discussed herein typically apply to each said working chamber and the primary low pressure valve, secondary low pressure port and, where relevant, high pressure valve associated with each said working chamber, as appropriate. Typically, the or each low and high pressure manifold is in communication with more than one (for example, each) of the plurality of said working chambers.

According to a second aspect of the present invention there is provided a method of supplying fluid to or receiving fluid from a fluid working machine working chamber of cyclically varying volume, during an intake or discharge stroke of the working chamber respectively, comprising opening an electronically controllable primary low pressure valve, in phased relation to cycles of working chamber volume, to bring the working chamber into fluid communication with a low pressure manifold under the active control of a controller on a cycle by cycle basis, characterised in that the method further comprises opening a secondary low pressure port, in phased relation to cycles of working chamber volume, to bring the working chamber into fluid communication with a low pressure manifold by a second path, such that, during a portion of at least some cycles of working chamber volume, the primary low pressure valve and secondary low pressure port are open concurrently such that fluid flows into or out of the working chamber, as appropriate, through both the primary low pressure valve and the secondary low pressure port.

Preferably, during at least some cycles of working chamber volume in which both the said primary low pressure valve and the said secondary low pressure port are open concurrently, the controller is operable to close the primary low pressure valve a period of time after the secondary low pressure port closes.

Further optional features of the second aspect of the invention correspond to those discussed in relation to the first aspect of the invention above.

According to a third aspect of the present invention there is provided a fluid working machine comprising a controller and a working chamber of cyclically varying volume, the working chamber having a high pressure valve associated therewith to control the connection of the working chamber to a high pressure manifold, and an electronically controllable primary low pressure valve to control the connection of the working chamber to a low pressure manifold, the controller being operable to actively control at least the primary low pressure valve, in phased relationship to cycles of working chamber volume, to determine the net displacement of fluid by the working chamber on a cycle by cycle basis, the fluid working machine being operable to carry out a motoring cycle under at least some circumstances, characterised in that the fluid working machine is adapted to release pressurised fluid from the working chamber prior to the opening of the primary low pressure valve, during a motoring cycle.

The resulting release of pressurised fluid preferably facilitates the opening of the primary low pressure valve. Preferably, the high pressure valve is also electronically controllable and the at least one valve actively controlled by the controller typically also comprises the high pressure valve.

The fluid working machine may comprise depressurisation means which are operable to release pressurised fluid from the working chamber prior to the opening of the primary low pressure valve, during a motoring cycle, to facilitate the opening of the primary low pressure valve.

Preferably, the working chamber has a secondary low pressure port associated therewith, which is openable and closable in phased relationship to the cycles of working chamber volume to release pressurised fluid from the working chamber, for example, by connecting the working chamber to a low pressure manifold, prior to the opening of the primary low pressure valve, during a motoring cycle, to reduce the pressure within the working chamber and thereby facilitate the opening of the primary low pressure valve.

Thus, by releasing pressurised fluid from the working chamber, prior to the opening of the low pressure valve, during a motoring cycle, the pressure within the working chamber drops more quickly than would otherwise be the case, or to a lower value than would otherwise be the case, facilitating the opening of the low pressure valve. Indeed, the opening of the secondary low pressure port may trigger the opening of the primary low pressure valve.

By releasing pressurised fluid from the working chamber prior to the opening of the primary low pressure valve we refer to releasing pressurised fluid from the working chamber prior to the opening of the primary low pressure valve during a given motoring cycle. Typically, the pressurised fluid is released during the second half of an expansion stroke. Typically, the pressurised fluid is released after the high pressure valve closes. Typically, the pressurised fluid is released between the time when the high pressure valve closes and the time when the primary low pressure valve opens.

Preferably, the secondary low pressure port is openable and closable in phased relationship to the cycles of working chamber to release pressurised fluid from the working chamber, by way of a mechanical arrangement operatively linked to the expansion and contraction cycles of the working chamber. Advantageously, a mechanical arrangement can be provided which can open against a significant pressure differential, which substantially exceeds the pressure differential against which the low pressure valve can open.

The timing of the opening and closing of the secondary low pressure port is selected depending on the intended application of the fluid working machine. For example, where the fluid working machine comprises a rotatable shaft (e.g. in a rotary piston machine) and the fluid working machine is adapted so that the rotatable shaft rotates always or primarily in one direction, the period of time between the opening of the secondary low pressure port and bottom dead centre may be different to the period of time between bottom dead centre and the closing of the secondary low pressure port. Where the fluid working machine operates always or primarily as a motor, the secondary low pressure port may be opened slightly before, at, or slightly after bottom dead centre, and the secondary low pressure port may close significantly after bottom dead centre, and preferably at or after the point of maximum rate of change of working chamber volume intermediate bottom dead centre and top dead centre. Where the fluid working machine operates primarily as a pump, the secondary low pressure port may close slightly before, or at, bottom dead centre.

Where the secondary low port associated with the working chamber is openable and closable in phased relationship to the cycles of working chamber volume to connect the working chamber to a low pressure manifold, prior to the opening of the low pressure valve, during a motoring cycle, to release pressurised fluid and thereby reduce the pressure within the working chamber and facilitate the opening of the low pressure valve, it may be that the secondary low pressure port remains open until at least the point in the subsequent contraction stroke where the rate of decrease of working chamber volume is greatest, to facilitate the flow of fluid out of the working chamber to one or more low pressure manifolds. However, it may be that the secondary low pressure port closes shortly after the low pressure valve has opened. It may be that the secondary low pressure port closes before the low pressure valve opens.

The fluid working machine may comprise a rotatable shaft, such as a crankshaft. In this case, the opening and closing of the secondary low pressure port may be operatively linked by a mechanical arrangement to the angle of the rotatable shaft. Accordingly, the primary low pressure valve may be openable on a cycle by cycle basis under the active control of the controller, but the opening and closing of the secondary low pressure port may not be variable on a cycle by cycle basis, and may be fixedly phase locked to the expansion and contraction cycle of the working chamber, e.g. by virtue of a mechanical arrangement operatively linked to the angle of a rotatable shaft, where present. The secondary low pressure port may comprise a mechanically actuated valve operated by a pushrod mechanically linked to the expansion and contraction cycles of the working chamber.

The secondary low pressure port may comprise one or more apertures in the working chamber, for example, where the working chamber comprises a hollow piston, the secondary low pressure port may comprise an aperture in the hollow piston, such as an aperture in the base of the hollow piston. The fluid working machine may be operable to bring one or more fluid conducting conduits periodically into alignment with the said one or more apertures to thereby bring the working chamber into fluid communication with a manifold for a period of time, typically in phased relation with, and preferably phase locked to, cycles of working chamber volume. Where the fluid working machine comprises a plurality of said working chambers, a single fluid conducting conduit may periodically align with the apertures associated with a plurality of said working chambers in turn. Typically, the or each fluid conducting conduit is formed in a rotatable member, such as a rotatable shaft, or a rotatable eccentric or shaft having a plurality of lobes, such as a ring cam.

For example, the fluid working machine may be a piston pump, with the working chamber having a volume defined by a cylinder and reciprocating piston, for example, a hollow piston. The fluid working machine may be a radial piston pump in which a cylinder has a base in sliding contact with an eccentric attached to (typically integrated into the surface of) a rotatable crankshaft. Where the fluid working machine comprises a plurality of said working chambers defined by cylinders, each of which has a base in sliding contact with the same eccentric, the eccentric may include one or more fluid conducting conduits adapted to periodically bring an aperture in the base of each cylinder which is in sliding contact with the eccentric into fluid communication with a low pressure manifold in turn, thereby opening the secondary low pressure port associated with each working chamber in turn in phased relation to cycles of working chamber volume to bring each working chamber into, and subsequently out of, fluid communication with the said low pressure manifold. The said low pressure manifold may comprise the crankshaft case of a radial piston pump. The one or more fluid conducting conduits may comprise one or more peripheral slots extending around part of the circumference of the eccentric. Thus, the or each peripheral slot may periodically bring the interior of pistons into fluid communication with fluid within the surrounding crankshaft case in phased relation to cycles of working chamber volume.

Alternatively, the fluid working machine may be an axial piston pump in which the working chamber has a volume defined by a cylinder and reciprocating piston, for example, a hollow piston, driven by and in communication with a wobble plate, wherein the working chamber comprises an aperture which functions as the secondary low pressure port and the wobble plate comprises one or more fluid conducting conduits adapted to periodically bring the said aperture in the base of the cylinder into fluid communication with a low pressure manifold, thereby periodically opening the secondary low pressure port of the working chamber. Where a plurality of said working chambers are provided, more than one of which has a volume defined by a cylinder and reciprocating piston in communication with the same wobble plate, the one or more fluid conducting conduits are preferably arranged to periodically bring the aperture in the base of each said working chamber into fluid communication with a low pressure manifold to thereby open the secondary low pressure port of each said working chamber in turn. The low pressure manifold in communication with the one or more fluid conducting conduits may comprise the crankshaft case of an axial piston pump. The one or more fluid conducting conduits may comprise one or more slots in the surface of the wobble plate arranged to periodically bring the interior of the piston, or each of the said plurality of pistons in turn, into, and subsequently, out of, fluid communication with fluid within the surrounding crankshaft case in phased relation to cycles of working chamber volume.

Thus, the secondary low pressure port may comprise one or more apertures in the working chamber which are periodically revealed, or brought into alignment with a fluid conduit, for example, a groove inlaid into the surface of a rotatable crankshaft. Where the working chamber comprises a hollow piston which reciprocates within a cylinder, the secondary low pressure port may comprise an aperture in either or both of the hollow piston, or the cylinder, which aperture is revealed, or which apertures are aligned, during a motoring cycle, towards the end of the expansion stroke to release pressurised fluid from the working chamber, reducing the pressure within the working chamber, and thereby facilitating the opening of the low pressure valve. Preferably, the pressure differential between the working chamber and the low pressure manifold into which the secondary low pressure port releases pressurised fluid exceeds the pressure differential against which the primary low pressure valve can open by a factor of at least 10, and typically at least 100 or at least 1,000.

The fluid working machine may be a motor, in which case it may be operable to carry out only motoring cycles. However, the fluid working machine may be operable to function as either a motor or a pump in different operating modes, in which case it will only carry out motoring cycles in circumstances where it is operating as a motor.

The fluid working machine typically comprises a plurality of said working chambers. Pressurised fluid may be released from individual said working chambers, or individual groups of said working chambers, at different times within cycles of the volume of the respective working chambers, for example, individual said working chambers, or individual groups of said working chambers, may release pressurised fluid by way of a secondary low pressure port at different times in cycles of the volume of the respective working chambers. Thus, individual working chambers, or individual groups of working chambers, may be optimised for different purposes.

The fluid working machine may also comprise one or more working chambers which are not operable to release pressurised fluid from the working chamber prior to the opening of the primary low pressure valve.

The fluid working machine may comprise a rotatable crankshaft having a plurality of working chambers arranged either individually, or in groups, at axially spaced apart locations along the length of the rotatable crankshaft, each axially spaced apart location having a peripheral slot in the rotatable crankshaft through which pressurised fluid can be released from the respective working chambers, wherein at least two peripheral slots are located at different angles around the axis of the crankshaft so that pressurised fluid cannot be retained simultaneously within all of the working chambers located on one side of the crankshaft, thereby reducing the maximum potential resultant force on the crankshaft. In this case, at least two peripheral slots are typically located on separate axially spaced eccentric cams, and it may be that the at least two said axially spaced eccentric cams are located at different angles around the axis of the crankshaft, with the respective peripheral slots each being located at a similar orientation relative to the eccentric cam on which they are located.

Further features of the third aspect of the invention may correspond to the features discussed above in connection with the first and second aspects of the invention.

According to a fourth aspect of the present invention there is provided a method of operating a fluid working machine working chamber of cyclically varying volume, during a motoring cycle of the working chamber, comprising opening an electronically controllable primary low pressure valve, in phased relation to cycles of working chamber volume, to bring the working chamber into fluid communication with a low pressure manifold under the active control of a controller on a cycle by cycle basis, characterised in that the method further comprises releasing pressure within the working chamber prior to the opening of the primary low pressure valve, during the expansion stroke of a said motoring cycle.

The resulting release of pressurised fluid preferably facilitates the opening of the primary low pressure valve. Preferably, pressure is released within the working chamber prior to the opening of the primary low pressure valve by opening a secondary low pressure port, through which fluid can be released from the working chamber.

Preferably also, the secondary low pressure port is opened by a mechanical arrangement which is operatively linked to cycles of working chamber volume. Typically, the fluid working machine comprises a rotatable shaft, and the opening of the secondary low pressure port is mechanically linked to the rotatable shaft.

Preferred and optional features of the method correspond to those features discussed in relation to the first three aspects of the invention.

According to a fifth aspect of the invention there is provided a fluid working machine comprising a controller and a working chamber of cyclically varying volume, the working chamber having an electronically controllable primary low pressure valve associated therewith to control the connection of the working chamber to a low pressure manifold, the controller being operable to actively control at least the primary low pressure valve, in phased relationship to cycles of working chamber volume, to determine the net displacement of fluid by the working chamber on a cycle by cycle basis, characterised in that, in use, during a pumping cycle of working chamber volume, the primary low pressure valve is closed at the beginning of an expansion stroke so that the working chamber is sealed and the pressure within the working chamber thereafter drops sufficiently below the pressure of the low pressure manifold to pull open the primary low pressure valve.

Preferably, the pressure within the working chamber drops sufficiently low as to cause cavitation within the working chamber. Preferably, the fluid working machine is a pump, or a machine which is operable to function as a pump or a motor in alternative operating modes.

According to a sixth aspect of the invention there is provided a method of operating a fluid working machine having a working chamber of cyclically varying volume, a low pressure manifold and an electronically controllable primary low pressure valve, characterised by the steps carried out during a pumping cycle of working chamber volume, of the primary low pressure valve being closed before the working chamber reaches a volume minimum such that the working chamber is sealed and the working chamber remaining sealed as the volume of the working chamber begins to expand such that the pressure within the working chamber drops sufficiently below the pressure of the low pressure manifold to pull open the primary low pressure valve.

Typically, at least the primary low pressure valve is actively controlled, in phased relationship to cycles of working chamber volume, to determine the net displacement of fluid by the working chamber on a cycle by cycle basis.

Preferably, the pressure within the working chamber drops sufficiently low as to cause cavitation within the working chamber. Preferably, the fluid working machine is a pump, or a machine which is operable to function as a pump or a motor in alternative operating modes.

Further optional and preferred features of the fifth and sixth aspects of the invention correspond to those discussed above in relation to the first four aspects of the invention.

The invention also extends in a seventh aspect to program code which, when executed on a fluid working machine controller, causes the fluid working machine to function as a fluid working machine according to the first aspect of the invention, or to cause the fluid working machine to function as a fluid working machine according to the third aspect of the invention, or to function as a fluid working machine according to the fifth aspect of the invention to carry out a method according to the second aspect of the invention, or to carry out a method according to the fourth aspect of the invention or to carry out a method according to the sixth aspect of the invention.

The program code may take the form of source code, object code, a code intermediate source, such as in partially compiled form, or any other form suitable for use in the implementation of the methods of the invention. The program code may be stored on or in a carrier, which is typically a computer readable carrier such as a ROM, for example a CD ROM or a semiconductor ROM, or a magnetic recording medium, for example a floppy disc or hard disc. Furthermore, the carrier may be a transmissible carrier such as an electrical or optical signal which may be conveyed via electrical or optical cable or by radio or other means. When a program is embodied in a signal which may be conveyed directly by cable, the carrier may be constituted by such cable or other device or means.

DESCRIPTION OF THE DRAWINGS

An example embodiment of the present invention will now be illustrated with reference to the following Figures in which.

DETAILED DESCRIPTION OF EXAMPLE EMBODIMENTS

EXAMPLE ONE

Figure 1:
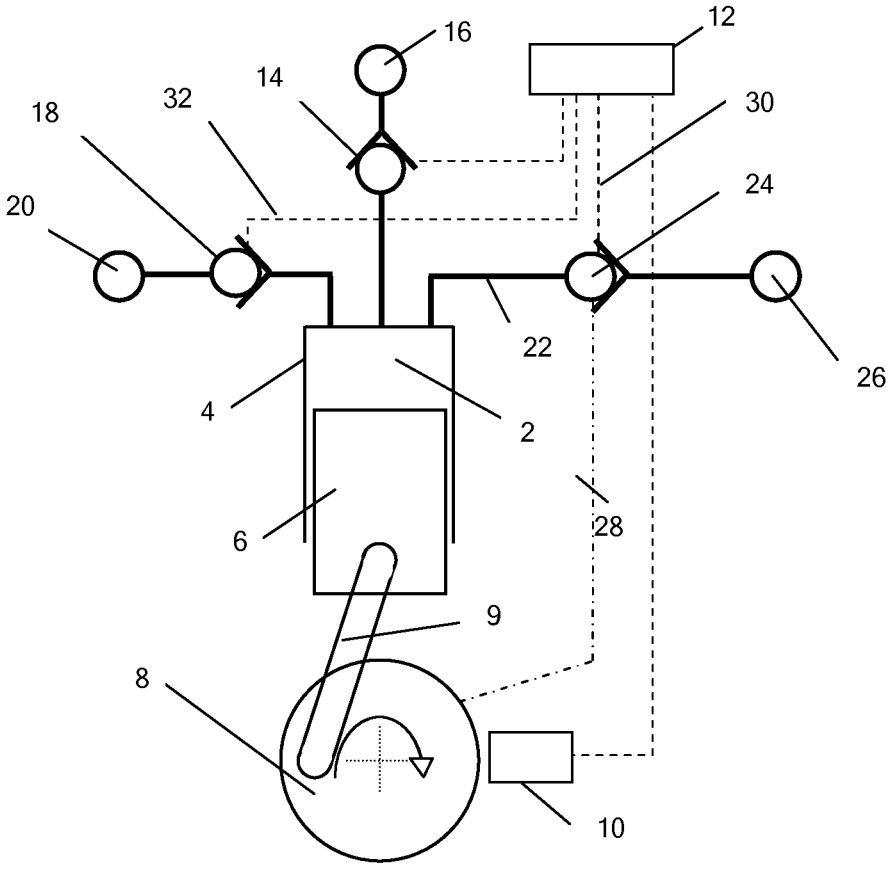
FIG. 1 is a schematic diagram of an individual working chamber of a fluid working machine.

In a first example, a fluid working machine in the form of a hydraulic pump includes a plurality of working chambers. FIG. 1 illustrates an individual working chamber 2 which has a volume defined by the interior surface of a cylinder 4 and a piston 6 which is driven from a crankshaft 8 by a crank mechanism 9 and which reciprocates within the cylinder to cyclically vary the volume of the working chamber. A shaft position and speed sensor 10 determines the instantaneous angular position and speed of rotation of the shaft, and transmits shaft position and speed signals to a controller 12, which enables the controller to determine the instantaneous phase of the cycles of each individual working chamber. The controller is typically a microprocessor or microcontroller which executes a stored program in use.

The working chamber comprises a primary low pressure valve in the form of an electronically actuatable face-sealing poppet valve 14, which faces inwards toward the working chamber and is operable to selectively seal off a channel extending from the working chamber to a first low pressure manifold 16, which functions generally as a net source of fluid in use. The primary low pressure valve is a normally open solenoid closed valve which opens passively when the pressure within the working chamber is less than the pressure within the first low pressure manifold, during an intake stroke, to bring the working chamber into fluid communication with the first low pressure manifold, but is selectively closable under the active control of the controller to bring the working chamber out of fluid communication with the first low pressure manifold. One skilled in the art will appreciate that alternative electronically controllable valves may be employed, such as normally closed solenoid opened valves.

The working chamber further comprises a high pressure valve 18 in the form of a pressure actuated delivery valve. The high pressure valve faces outwards from the working chamber and is operable to seal off a channel extending from the working chamber to a high pressure manifold 20, which functions as a net sink of fluid in use. The high pressure valve functions as a normally-closed pressuring-opening check valve which opens passively when the pressure within the working chamber exceeds the pressure within the high pressure manifold.

A secondary low pressure port 22 is openable and closable by means of a secondary low pressure valve 24 which, when open, brings the working chamber into fluid communication with a second low pressure manifold 26, which also functions as a net source of fluid in use. In this example, the primary low pressure valve and the secondary low pressure port are connected to two distinct low pressure manifolds of similar pressure. However, they may alternatively be connected to the same low pressure manifold. The opening and closing of the secondary low pressure port may be phase locked to the working cycle of the working chamber, for example, by virtue of a mechanical linkage 28 between the crankshaft and the secondary low pressure valve. Alternatively, the opening or closing of the secondary low pressure valve may be actively controlled by the controller, by virtue of an electronic connection 30. Alternatively, the secondary low pressure valve may be a normally-closed pressure-openable check valve which opens responsive to a drop in the pressure of the working chamber relative to the second low pressure manifold in which case neither the mechanical linkage nor the electronic connection need to be present.

Figure 2:
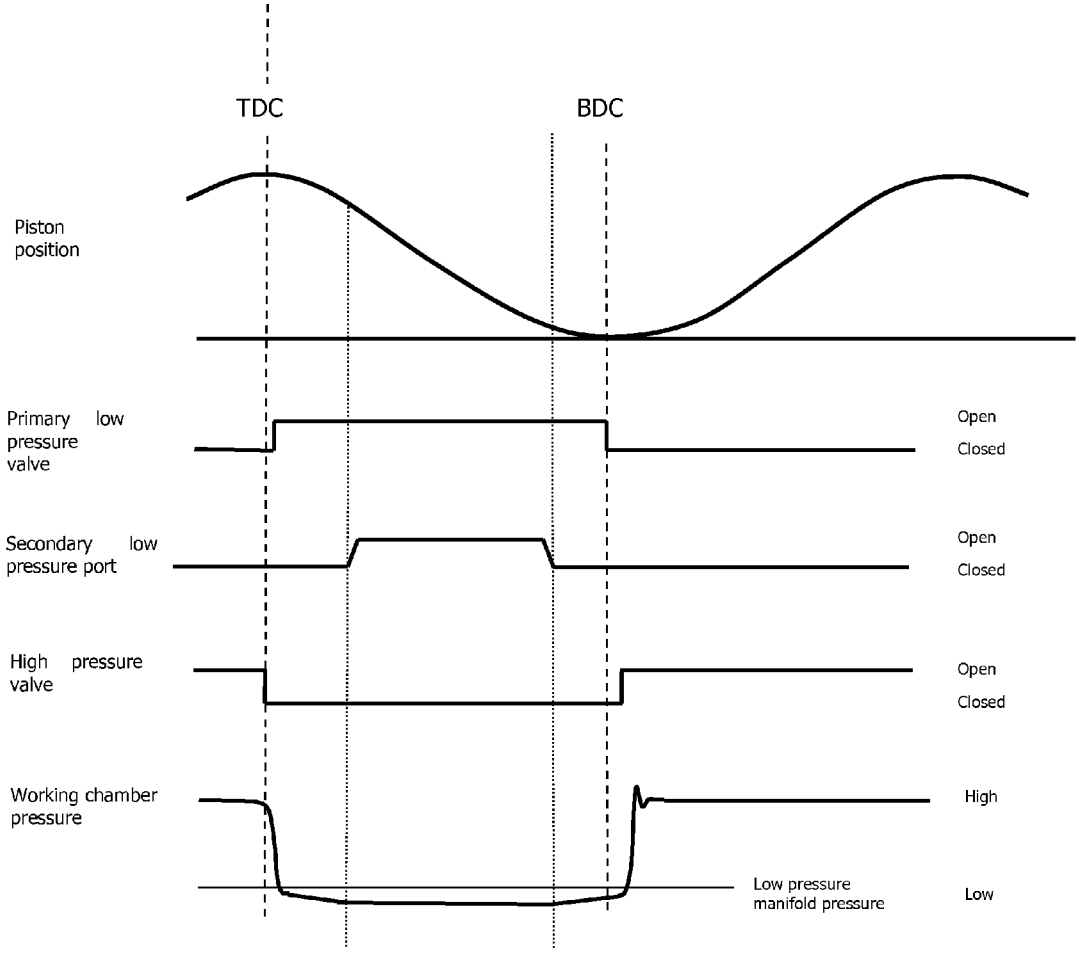
FIG. 2 is a timing diagram illustrating the status of the primary low pressure valve, the secondary low pressure port, and the high pressure valve, as well as the pressure within a working chamber during a pumping cycle.

FIG. 2 is a timing diagram illustrating the status of the primary low pressure valve, the secondary low pressure port, and the high pressure valve, as well as the pressure within the working chamber during a pumping cycle. The primary low pressure valve opens at or around top dead centre due to the pressure difference between the first low pressure manifold and the working chamber which allows fluid to flow into the working chamber from the first low pressure manifold to begin an intake stroke. The increasing velocity of fluid past the primary valve causes the working chamber pressure to fall until, for a period of time during the intake stroke, the secondary low pressure valve opens. Opening of the secondary low pressure port may be mechanically phase locked to the position of the crankshaft and occur a period of time after the opening of the primary low pressure valve. Alternatively, the opening of the secondary low pressure valve may be caused by the increasing pressure difference between the low pressure manifold and the working chamber. The secondary low pressure port is open at the point in the pumping cycle when the rate of change of working cylinder volume is greatest and the additional fluid flow is of greatest benefit.

Once the secondary low pressure valve has opened, hydraulic fluid enters the working chamber from the low pressure manifold via both the primary low pressure valve and the secondary low pressure port. After a period of time, the secondary low pressure valve closes so that fluid once again enters the working chamber from the low pressure manifold only through the primary low pressure valve.

The controller determines the phase of the working chamber pumping cycle using the received shaft position and speed signals and, at or around bottom dead centre, makes a decision as to whether to select a pumping cycle or an idle cycle. In the example illustrated in FIG. 2, the controller selects a pumping cycle and sends a signal causing the primary low pressure valve to close. The primary low pressure valve closes a period of time after the closure of the secondary low pressure port. Once the primary low pressure valve closes, the working chamber is isolated from the low pressure manifolds, the pressure in the working chamber increases and the high pressure valve opens to receive a defined volume of fluid into the high pressure manifold. During other cycles, the controller may alternatively cause the primary low pressure valve to remain open so that low pressure fluid received from both low pressure manifolds is vented back to the first low pressure manifold with no net displacement of fluid from the low pressure manifolds to the high pressure manifolds.

By providing a secondary low pressure port, the flow characteristics of the hydraulic fluid entering the working chamber during an intake stroke are better than would be the case if only the primary low pressure valve was provided. For example, less cavitation occurs and less drag is exerted to resist expansion of the working chamber than would otherwise be the case. However, because the opening and closing of the secondary low pressure port is phased away from the opening and closing of the primary low pressure valve, the electronically controllable primary low pressure valve controls the timing of the communication between the working chamber and the first low pressure manifold to start and finish the intake stroke. Thus, the primary low pressure valve may have a smaller fluid flow cross-section than would be the case if all of the fluid entered the working chamber through the primary low pressure valve.

Importantly, as well as determining whether or not to close or hold open the primary low pressure valve on a cycle by cycle basis, the controller is operable to vary the precise phasing of the closure of the primary low pressure valve with respect to the varying working chamber volume to determine the net displacement of fluid from the low pressure manifolds to the high pressure manifold during a pumping cycle. As described above, by keeping the primary low pressure valve open throughout a cycle an idle stroke can occur in which, although fluid flows into the working chamber from the low pressure manifolds and flows out to the first low pressure manifold there is no net displacement from the low pressure manifolds to the high pressure manifold. (There may be net displacement from the second low pressure manifold to the first low pressure manifold, but this is not considered to be net displacement by the pump). A partial stroke which displaces a volume of fluid equal to a proportion (usually a relatively small proportion) of the capacity of the working chamber may be implemented by delaying closure of the primary low pressure valve and opening of the high pressure valve until just before top dead centre, and the precise volume which is displaced may be selected by the precise timing of these events. The precise timing of the opening and/or closing of the primary low pressure valve and the high pressure valve may also be varied in specific circumstances, such as start-up, operation while still relatively cold, and shut down of the device. Further details of these timing options are disclosed in EP 0 361 927, EP 0 494 236 and EP 1 537 333, the contents of which are incorporated herein by virtue of this reference.

Fluid discharged through the high pressure manifold is typically delivered to a pressure accumulator to smooth the output pressure and the time averaged throughput is varied by the controller on the basis of a demand signal received by the controller in the manner of the prior art.

EXAMPLE TWO

In a second example, the fluid working machine is operable to function as either a motor or a pump. The structure of the second example fluid working machine also corresponds to the structure illustrated in FIG. 1. In this embodiment, the primary low pressure valve functions as a net source of fluid or a net sink in pumping or motoring mode respectively. The secondary low pressure port also functions as either a net source of fluid or net sink respectively, and the high pressure valve functions as either a net sink of fluid or net source respectively. A single low pressure manifold functions as either a net source of fluid, in pumping mode, or as a sink of fluid, in motoring mode, and the high pressure manifold functions as either a sink of fluid, in pumping mode, or as a source of fluid, in motoring mode. During idle strokes in which a working chamber is kept in fluid communication with the low pressure manifold, neither manifold functions as a net source or sink of fluid.

As with the first example, the primary low pressure port is an inward facing electronically controllable poppet valve. However, in this example, the secondary low pressure port and the high pressure valve also comprise electronically actuatable poppet valves which face inwards and outwards respectively and which are actively controllable by the controller on a cycle by cycle basis through electronic connections 30 and 32. In pumping mode, the timings of the secondary low pressure port and the high pressure valve are the same as in the first example. In motoring mode, fluid is received through the high pressure valve during working chamber expansion strokes to drive the crankshaft and output through the primary low pressure valve during working chamber contraction strokes. The secondary low pressure port opens for a portion of the contraction stroke to provide an additional path for fluid to be displaced from the working chamber.

By using an electronically controllable valve to regulate the secondary low pressure port, rather than a mechanical arrangement driven from the crankshaft, the controller can open the secondary low pressure port during expansion strokes when the fluid working machine is operating as a pump and during contraction strokes when the fluid working machine is operating as a motor.

In an alternative implementation of this second example embodiment, the secondary low pressure port may be closed by means of a pressure-operated check valve not under the control of the controller. The pressure-operated check valve allows fluid to be received into the cylinder from the low pressure manifold on the expansion stroke when the primary low pressure valve is open. By using a pressure-operated check valve to provide a second path for fluid to enter the working chamber, the working chamber is more easily able to receive fluid from the low pressure manifold and can thus avoid cavitation. The pressure-operated check valve will be closed on the contraction stroke either when exhausting to the low pressure manifold in an idle or motor exhaust stroke, and closed on the expansion stroke during a motor stroke.

EXAMPLE THREE

Figure 3:
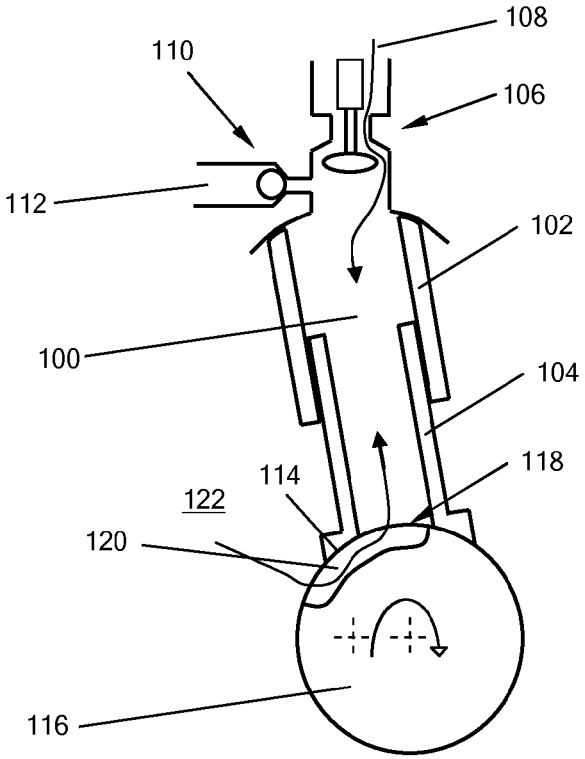
FIG. 3 is a schematic diagram of fluid flow into a working chamber of a hydraulic radial piston pump, during an expansion stroke.

In a third example embodiment a fluid working machine in the form of a hydraulic radial piston pump uses a slotted crankshaft to provide a secondary low pressure port. FIG. 3 illustrates fluid flow through an individual working chamber 100, defined by the interior surface of a cylinder 102 and reciprocating hollow piston 104, part way through an expansion stroke.

The working chamber has a primary low pressure valve 106, in the form of an electronically controllable poppet valve, which is openable and closable to bring the working chamber into and out of fluid communication with a first low pressure manifold 108. A high pressure valve in the form of a pressure-operable discharge valve 110 is openable and closable to bring the working chamber into and out of fluid communication with a high pressure manifold 112. The base 114 of the piston is in sliding contact with a crankshaft eccentric 116. An aperture 118 in the base of the piston functions as a secondary low pressure port which is open when a slot 120, which extends around a portion of periphery of the eccentric, extends across either side of the piston wall to bring the interior of the working chamber into fluid communication with hydraulic fluid within the crankshaft case 122, which functions as a second low pressure manifold. Accordingly, for a portion of the expansion stroke, fluid will flow into the working chamber both (i) through the primary low pressure valve and (ii) through the crankshaft slot and the aperture in the base of the piston.

As before, the secondary low pressure port opens a period of time after the primary low pressure valve opens due to the pressure in the working chamber 100 falling to a level where it is no longer held closed, and the secondary low pressure port closes a period of time before the controller may optionally send a signal to cause the primary low pressure valve to close so as initiate the pumping mode on the contraction stroke.

Figure 4:
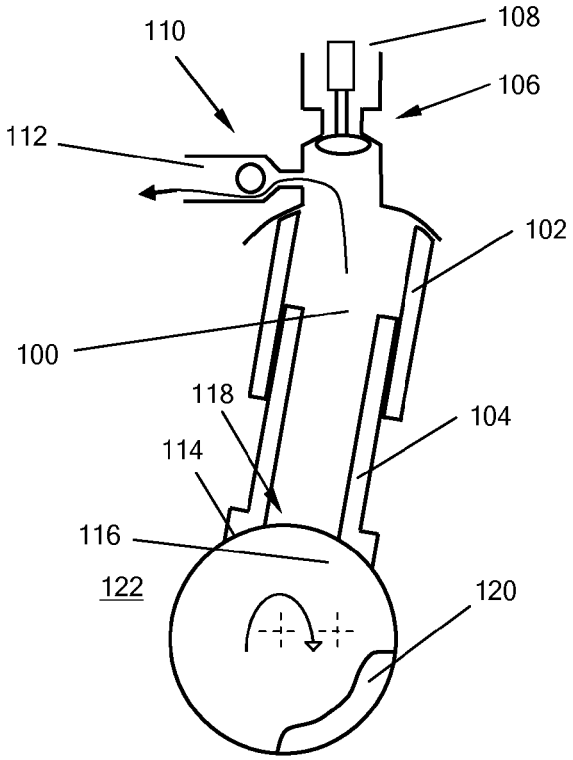
FIG. 4 is a schematic diagram of fluid flow out of a working chamber of the hydraulic radial piston pump of FIG. 3, during a contraction stroke.

FIG. 4 illustrates the fluid flow during the subsequent contraction stroke, where the primary low pressure valve and secondary low pressure port are both closed, by the electronically controllable poppet valve and the body of the crankshaft eccentric respectively, and fluid is displaced to the high pressure manifold through the high pressure discharge valve. The opening and closing of the secondary low pressure port is phase locked to the cycles of working chamber volume, as defined by the location of the slot on the crankshaft eccentric. The variation in working chamber pressure during the expansion and contraction strokes corresponds to that illustrated in FIG. 2.

This arrangement has several advantages. Firstly, by supplying fluid concurrently from either end of the elongate working chambers during the part of the expansion stroke where the volume of the working chambers is most rapidly increasing, fluid need not flow as quickly and so the flow characteristics of fluid entering the working chambers are improved. Secondly, there is not a pool of fluid at the moving end of each working chamber which can remain in place from one cycle to the next. A fresh supply of fluid enters the aperture in the base of each piston during each cycle, cooling the base of each piston. Furthermore, centrifugal forces act in the same direction as net fluid flow from the crankshaft to the high pressure outlet, increasing the overall efficiency of the pump.

EXAMPLE FOUR

Figure 5:
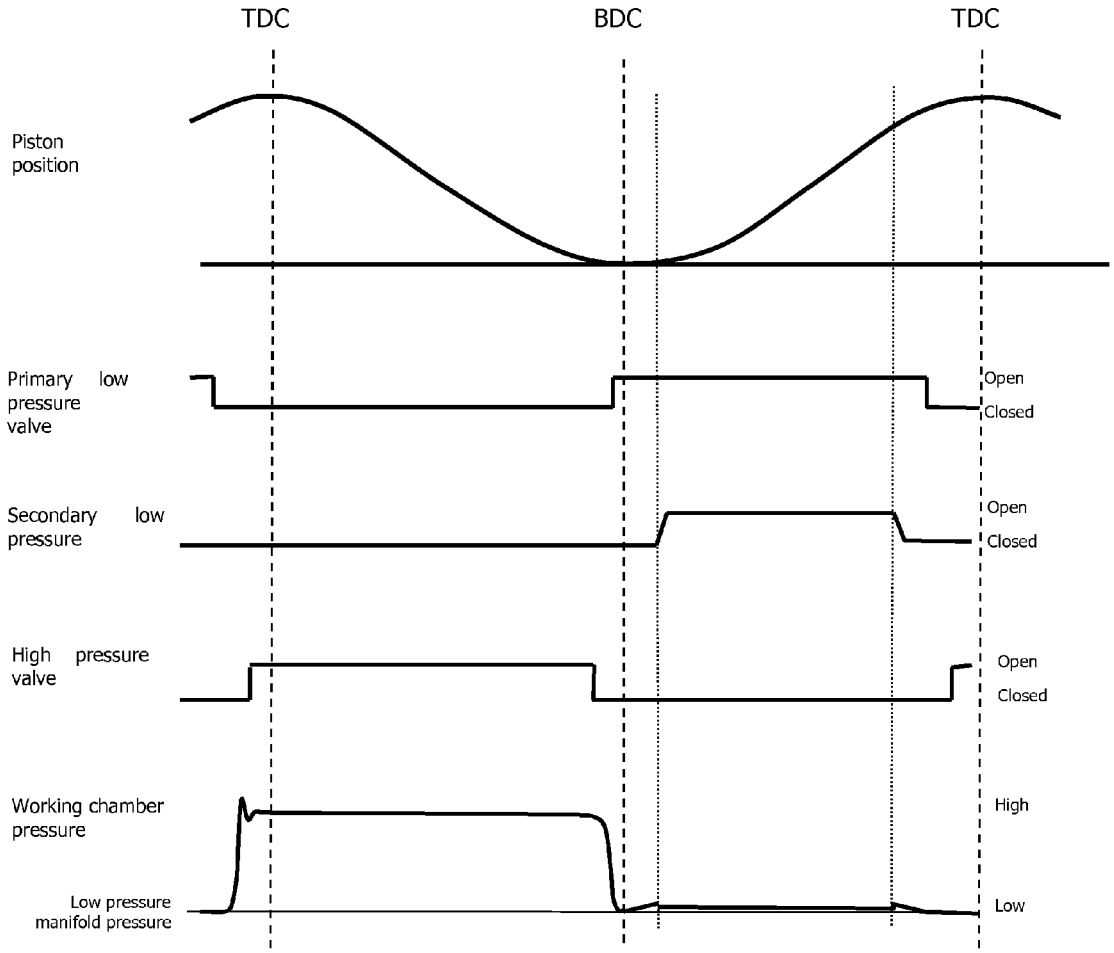
FIG. 5 is a timing diagram illustrating the status of the primary low pressure valve, the secondary low pressure port, and the high pressure valve, as well as the pressure within a working chamber during a motoring cycle.

The arrangement of FIGS. 3 and 4 can operate as a hydraulic radial piston motor by the use of an active high pressure valve and by changing the location of the slot on the crankshaft to amend the phase of the opening of the secondary low pressure port so that the secondary low pressure port opens during the contraction stroke rather than the expansion stroke. FIG. 5 illustrates the opening and closing of the phase-locked secondary low pressure port during the motoring cycle. In this case the pressure in the working chamber rises during the exhaust of fluid to the low pressure manifold through the primary low pressure port, until the opening of the phase-locked secondary low pressure port provides an alternative flow path and reduces the working chamber pressure.

EXAMPLE FIVE

A fifth example embodiment addresses technical problems related to the opening of a low pressure valve during a motoring cycle of a fluid working motor, or a fluid working machine which can operate as either a motor or a pump, in different operating modes.

This embodiment corresponds to the hydraulic radial piston motor of Example Four, except that the location of the slot on the crankshaft is positioned so that the secondary low pressure port opens shortly before the end of the expansion stroke, after the high pressure valve has closed, is phase locked to cycles of working chamber volume.

Figure 6:
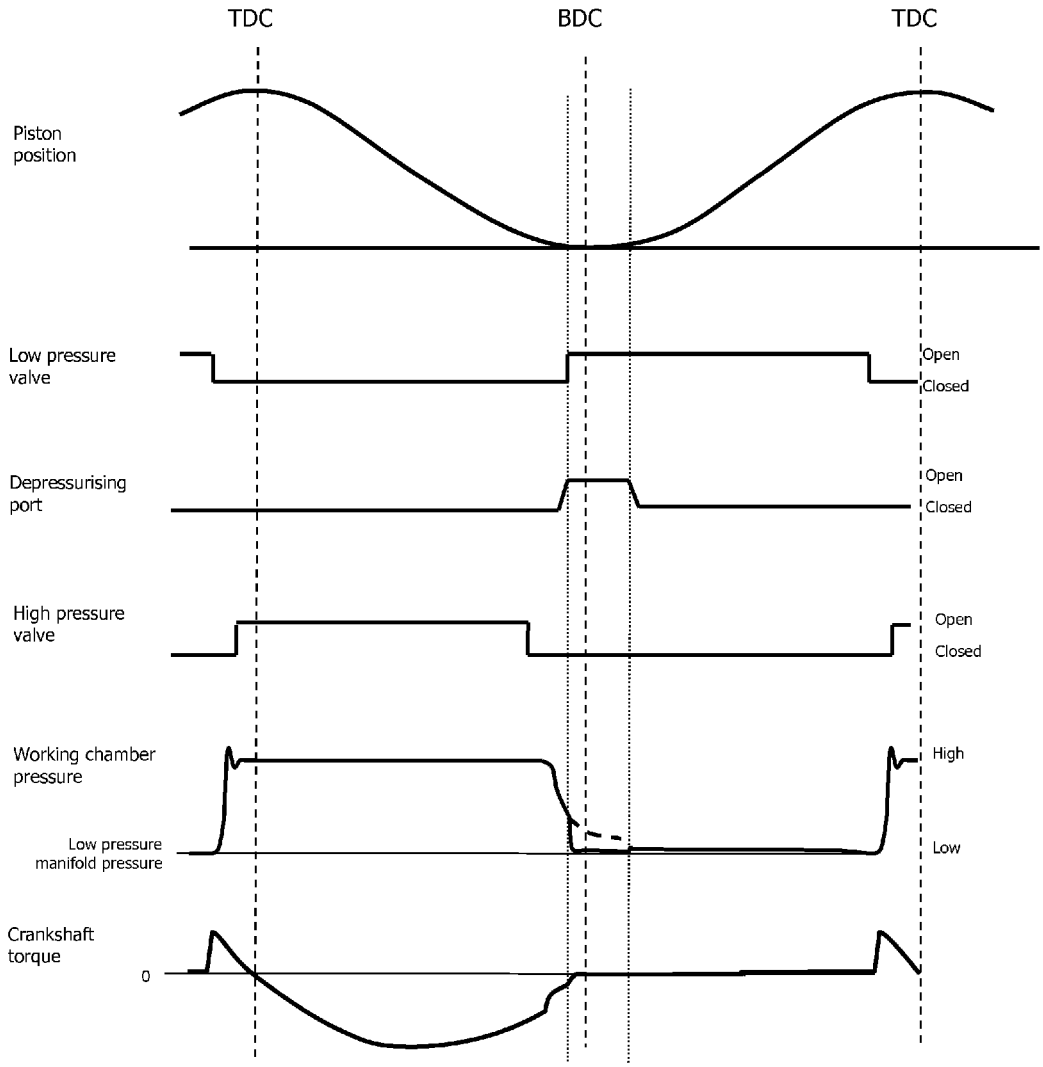
FIG. 6 is a timing diagram for a hydraulic motor, or hydraulic pump/motor, having a depressurising port, illustrating the status of the primary low pressure valve, depressurising port, and a high pressure valve, as well as the pressure within a working chamber, and the crank shaft torque, during a motoring cycle.
Figure 7:
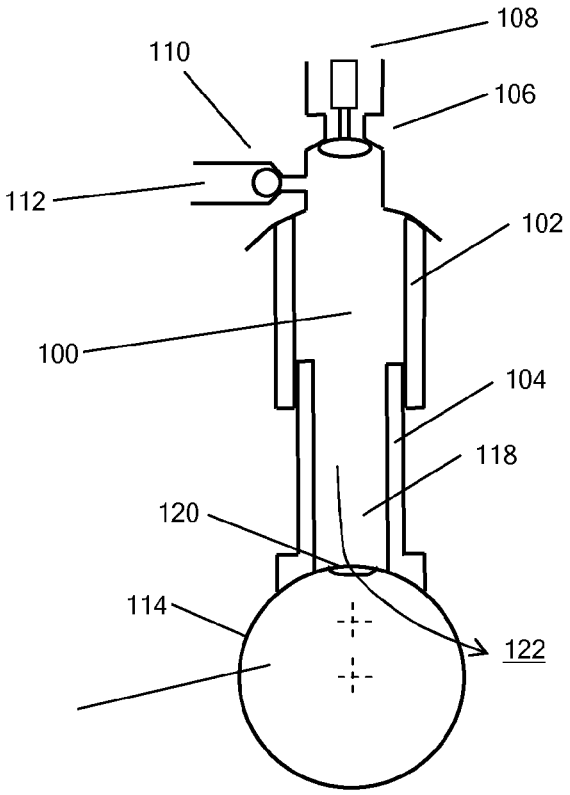
FIG. 7 is a schematic diagram of fluid flow out of a working chamber of a hydraulic motor, or hydraulic pump/motor having a depressurising port.

The effect of this arrangement on the operation of the fluid working machine is illustrated in FIG. 6. The operation of the fluid working motor is conventional during the first part of the expansion stroke. Pressurised fluid is received from the high pressure manifold into the working chamber, through an active high pressure valve. Once the high pressure valve is closed, the pressure within the working chamber begins to decrease, however, the fluid within the working chamber remains pressurised. After the closure of the high pressure valve, but before bottom dead centre, the slot aligns with the base of the working chamber piston forming a secondary low pressure port. Pressurised fluid vents from the interior of the working chamber into the crankshaft case via the crankshaft slot. Accordingly, the pressure within the working chamber drops rapidly to close to the pressure of the low pressure manifold. The low pressure valve, which is gently biased to an open position by a weak spring, therefore opens passively against only a minimal pressure differential. Shortly after bottom dead centre, the slot no longer aligns with the base of the piston and so the secondary low pressure port closes. The low pressure valve may alternatively be dragged open when the pressure within the working chamber is sufficiently low.

Because the slot is integral to the crankshaft, it can open despite the substantial pressure differential between the working chamber and the surrounding crankshaft case. An electronically controllable low pressure valve which could open against the substantial pressure differentials which occur at this point in a motoring cycle in many practical applications would require considerable power and/or open more slowly. Furthermore, the provision of a secondary low pressure port, or other depressurising means, enables the time which elapses between the closure of the high pressure valve and the opening of the low pressure valve to be less than would otherwise be the case, allowing the high pressure valve to close later and/or the low pressure valve to open earlier than would otherwise be the case and thereby minimising the amount of time that the working chamber is not either receiving high pressure fluid or releasing fluid to the low pressure manifold, and thereby increasing the energy efficiency of the fluid working machine. In the example illustrated in FIG. 6, were it not for the release of pressurised fluid using the secondary low pressure port, the pressure within the working chamber would follow the path illustrated with a dashed line, in which case the low pressure valve would not open.

It is also envisaged that the secondary low pressure port could remain open until at least the point in the contraction stroke where the volume of the working chamber is most rapidly changing, to enable fluid to flow out of the working chamber to the low pressure manifold through both the primary low pressure valve and the secondary low pressure port concurrently.

EXAMPLE SIX

Figure 8:
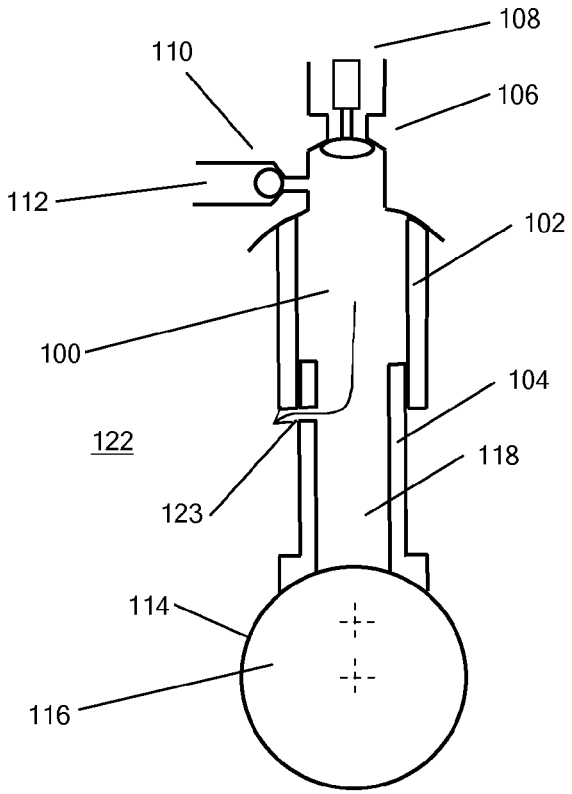
FIG. 8 is a schematic diagram of fluid flow out of a working chamber of an alternative embodiment of a hydraulic motor, or a hydraulic pump/motor, with a depressurising port.
Figure 9:
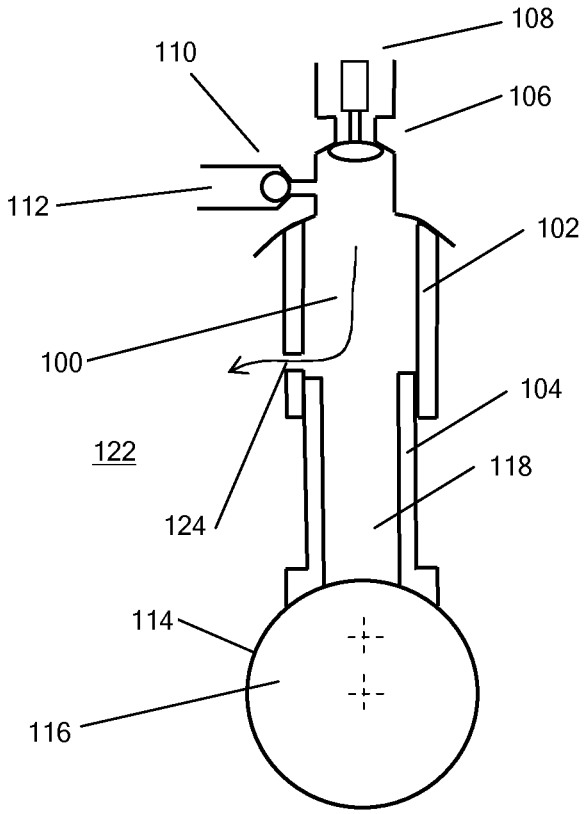
FIG. 9 is a schematic diagram of fluid flow out of the working chamber of a further example of a hydraulic motor, or hydraulic pump/motor with a depressurising port.

In further example embodiment, illustrated in FIG. 8, an aperture 123, is provided towards the radially outwards end of a piston. The portion of the piston which includes the aperture extends out of the cylinder, forming a secondary low pressure port through which hydraulic fluid can be released to the crankshaft case, from shortly before to shortly after bottom dead centre. In an alternative embodiment, illustrated in FIG. 9, an aperture 124 is instead provided towards the radially inwards end of the cylinder, forming a secondary low pressure port through which pressurised hydraulic fluid can be released to the crankshaft case, from shortly before to shortly after bottom dead centre. In a further embodiment, apertures can be provided in each of the piston and the cylinder which overlap for a period of time from shortly before to shortly after bottom dead centre.

One skilled in art will appreciate that secondary low pressure ports which open to vent fluid from the working chamber of a fluid working machine, during a motoring stroke, to facilitate the opening of a primary low pressure valve, could be implemented in numerous ways. Mechanically linking the opening and closing of the secondary low pressure port to cycles of working chamber volume has the advantage that the secondary low pressure port can be opened against a substantial pressure differential.

Figure 10:
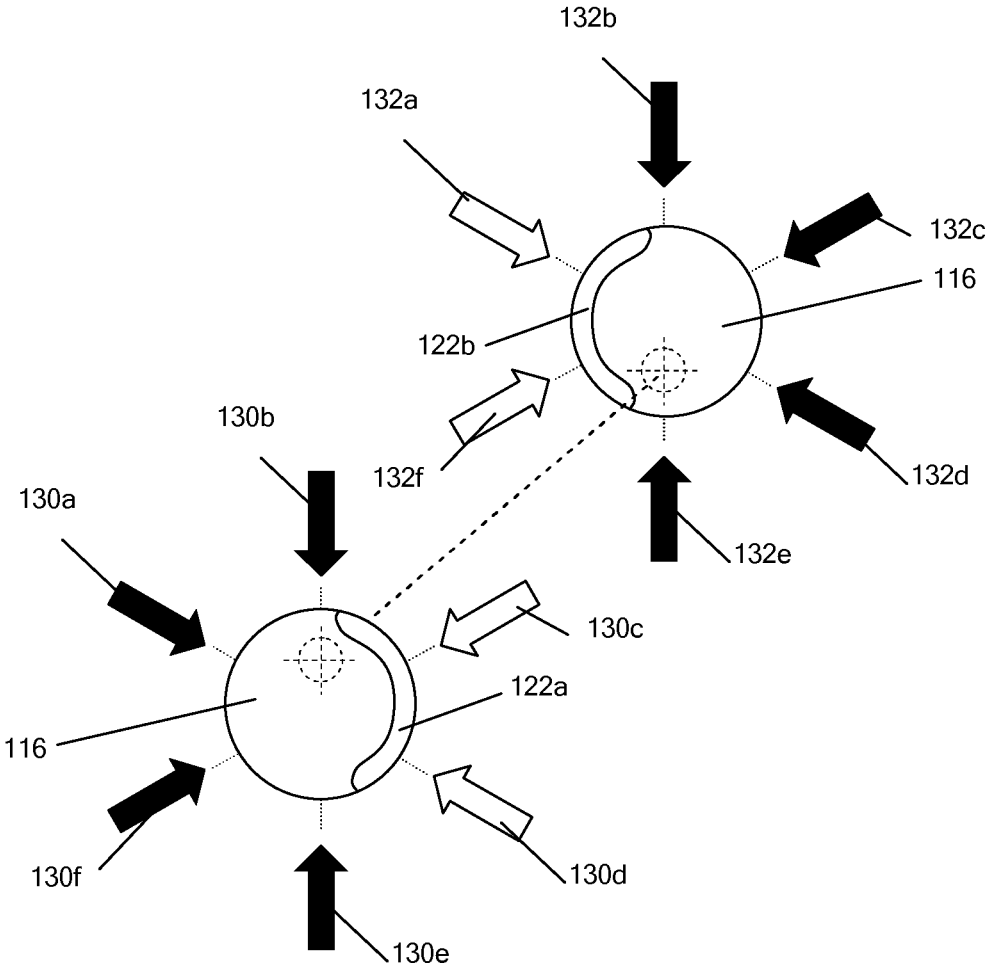
FIG. 10 is a schematic diagram showing the reduction in resultant forces on a crankshaft from the release of pressurised fluid from two banks of pistons.

With reference to FIG. 10, one possible implementation of the invention is in a fluid working machine, which includes a crankshaft, with a plurality of banks of working chambers (130*a* to 130*f*, and 132*a* to 132*f*) arranged at axially spaced apart locations along the crankshaft, each bank having an eccentric cam 116. Preferably, the eccentric cams are arranged in different phases with respect to each other. In this case, a peripheral slot in each crankshaft eccentric (122*a* and 122*b*) can be provided in respect of each bank of working chambers, and the peripheral slots in each crankshaft eccentric can be arranged at similar orientations with respect to the eccentric in which they lie, so that it is not possible to retain pressurised fluid simultaneously within all working chambers on any one side of the crankshaft. Because pressurised working chambers apply forces orthogonal to the axis of the crankshaft to said crankshaft, this reduces the maximum potential resultant force on the crankshaft, in a plane orthogonal to the axis of the crankshaft, reducing the net forces on the crankshaft, potentially increasing operating lifetime, and reducing vibration.

Further variations and modifications may be made within the scope of the invention herein disclosed.

The invention claimed is:

1. A fluid working machine comprising:

a controller and a working chamber of cyclically varying volume, the working chamber having an electronically controllable primary low pressure valve associated therewith to control the connection of the working chamber to a first low pressure manifold by a first path, the controller being operable to actively control at least the primary low pressure valve, in phased relationship to cycles of working chamber volume, to determine the net displacement of fluid by the working chamber on a cycle by cycle basis, wherein the working chamber further comprises a secondary low pressure port which is openable and closable in phased relationship to cycles of working chamber volume to connect the working chamber by a second path to either the first low pressure manifold or a second low pressure manifold different from the first low pressure manifold, to enable fluid to flow into or out of the working chamber concurrently and in parallel through both the primary low pressure valve and the secondary low pressure port during a portion of at least some cycles of working chamber volume, wherein the primary low pressure valve and the secondary low pressure port are openable concurrently and in parallel at the point in an expansion or contraction stroke where the rate of change of volume of the working chamber is greatest.

2. A fluid working machine according to claim 1, wherein the controller is operable, in respect of at least some cycles of working chamber volume in which both the primary low pressure valve and the secondary low pressure port are open concurrently, to close the primary low pressure valve a period of time after the secondary low pressure port closes.

3. A fluid working machine according to claim 1, comprising a plurality of said working chambers, wherein the controller is operable to control a plurality of electronically controllable valves, including at least the electronically controllable primary low pressure valve associated with each of the plurality of said working chambers, on a cycle by cycle basis, to determine the net displacement of fluid by each of the plurality of said working chambers.

4. A fluid working machine according to claim 1, wherein the fluid working machine is a pump, or a motor, or is operable to function as either a pump or a motor in different operating modes.

5. A fluid working machine according to claim 1, wherein the secondary low pressure port is openable and closable by a secondary electronically controllable valve.

6. A fluid working machine according to claim 1, wherein the secondary low pressure port is openable and closable by a normally-closed pressure-openable check valve.

7. A fluid working machine according to claim 1, wherein the secondary low pressure port is openable and closable by a mechanical arrangement operatively linked to the expansion and contraction cycle of the working chamber.

8. A fluid working machine according to claim 7, wherein the secondary low pressure port comprises one or more apertures in the working chamber and the fluid working machine comprises one or more fluid conducting conduits, the fluid working machine being operable to periodically bring the one or more fluid conducting conduits into alignment with the one or more apertures to thereby bring the working chamber into fluid communication with the low pressure manifold to which the secondary low pressure port is openable and closable to connect the working chamber for a period of time, in phased relation to cycles of working chamber volume.

9. A fluid working machine according to claim 7, wherein the fluid working machine is a radial piston pump, in which the working chamber has a volume defined by a cylinder and a reciprocating piston, the piston having a base in sliding contact with an eccentric attached to a rotatable crankshaft, the secondary low pressure port comprising an aperture in the base of the piston, wherein the eccentric comprises one or more fluid conducting conduits adapted to periodically bring the aperture into fluid communication with the low pressure manifold to which the secondary low pressure port is openable and closable to connect the working chamber in phased relation to cycles of working chamber volume.

10. A fluid working machine according to claim 1, wherein the secondary low pressure port is openable and closable in phased relationship to cycles of working chamber volume and is connected to the working chamber by the second path to the second low pressure manifold different from the first low pressure manifold, and wherein the primary low pressure valve and the secondary low pressure port are each openable to bring the working chamber into and out of fluid communication with different low pressure manifolds.

11. A fluid working machine according to claim 1, wherein the primary low pressure valve and the secondary low pressure port are provided spaced apart along a length of the working chamber.

12. A fluid working machine according to claim 1, wherein the working chamber is a piston cylinder having a generally fixed end and a moving end, and wherein the primary low pressure valve is provided at the fixed end of the cylinder and the secondary low pressure port is provided at the moving end of the cylinder.

13. A fluid working machine according to claim 1, further comprising a rotatable shaft, the angular displacement of which is mechanically linked to the instantaneous volume of the working chamber; and a shaft position sensor operable to determine the angular displacement of said rotatable shaft.

14. A fluid working machine according to claim 1, functioning as a pump wherein, in use, at the beginning of the expansion stroke of a pumping cycle, the primary low pressure valve and the secondary low pressure port are closed concurrently and the secondary low pressure port remains closed for a period of time which is sufficient to cause the pressure within the working chamber to drop below the pressure of the first low pressure manifold, such that there is a net pressure differential across the first low pressure manifold, urging the primary low pressure valve to open.

15. A fluid working machine according to claim 1, wherein the machine is functioning as a pump and the secondary low pressure port is openable during the expansion stroke but not openable during the contraction stroke, or wherein when the machine is functioning as a motor and the secondary low pressure port is openable during the contraction stroke but not openable during the expansion stroke.

16. A method of supplying fluid to or receiving fluid from a fluid working machine working chamber of cyclically varying volume, during an expansion or contraction stroke of the working chamber respectively, comprising:

opening an electronically controllable primary low pressure valve, in phased relation to cycles of working chamber volume, to bring the working chamber into fluid communication with a first low pressure manifold by a first path under the active control of a controller on a cycle by cycle basis, opening a secondary low pressure port, in phased relation to cycles of working chamber volume, to bring the working chamber into fluid communication with either the first low pressure manifold or a second low pressure manifold different from the first low pressure manifold by a second path, such that, during a portion of at least some cycles of working chamber volume, the primary low pressure valve and secondary low pressure port are open concurrently such that fluid flows into or out of the working chamber, as appropriate, through both the primary low pressure valve and the secondary low pressure port in parallel, wherein the primary low pressure valve and the secondary pressure port are open concurrently and in parallel at the point in the expansion or contraction stroke where the rate of change of volume of the working chamber is greatest.

17. A method according to claim 16, wherein in respect of at least some cycles of working chamber volume in which both said primary low pressure valve and said secondary low pressure port are open concurrently, the controller is operable to close the primary low pressure valve a period of time after the secondary low pressure port closes.

18. A method according to claim 16, wherein the fluid working machine is a pump, or a motor, or is operable to function as either a pump or a motor in different operating modes.

19. A method according to claim 16, wherein, in use, at the beginning of the expansion stroke of a pumping cycle, the primary low pressure valve and the secondary low pressure port are closed concurrently and the secondary low pressure port remains closed for a period of time which is sufficient to cause the pressure within the working chamber to drop below the pressure of the first low pressure manifold, such that there is a net pressure differential across the first low pressure manifold, urging the primary low pressure valve to open.

20. A non-transitory computer readable storage medium comprising program code for a fluid working machine controller of a fluid working machine further comprising a working chamber of cyclically varying volume, the working chamber having an electronically controllable primary low pressure valve associated therewith to control the connection of the working chamber to a first low pressure manifold by a first path and a secondary low pressure port which is openable and closable in phased relationship to cycles of working chamber volume to connect the working chamber by a second path to either the first low pressure manifold or a second low pressure manifold different from the first low pressure manifold, to enable fluid to flow into or out of the working chamber concurrently and in parallel through both the primary low pressure valve and the secondary low pressure port during a portion of at least some cycles of working chamber volume at the point in an expansion or contraction stroke where the rate of change of volume of the working chamber is greatest, wherein the program code executed on the fluid working machine controller is configured to cause at least the primary low pressure valve to be actively controlled, in phased relationship to cycles of working chamber volume, to determine the net displacement of fluid by the working chamber on a cycle by cycle basis.

21. A fluid working machine comprising:

a controller, and a working chamber of cyclically varying volume, the working chamber having an electronically controllable primary low pressure valve associated therewith to control the connection of the working chamber to a first low pressure manifold, the controller being operable to actively control at least the primary low pressure valve, in phased relationship to cycles of working chamber volume, to determine the net displacement of fluid by the working chamber on a cycle by cycle basis, wherein the working chamber further comprises a secondary low pressure port which is openable and closable in phased relationship to cycles of working chamber volume to connect the working chamber to either the first low pressure manifold or a second low pressure manifold different from the first low pressure manifold, to enable fluid to flow into or out of the working chamber concurrently and in parallel through both the primary low pressure valve and the secondary low pressure port during a portion of at least some cycles of working chamber volume, wherein the machine is functioning as a pump and the secondary low pressure port is openable during an expansion stroke but not during a contraction stroke, or wherein the machine is functioning as a motor and the secondary low pressure port is openable during the contraction stroke but not during the expansion stroke.

* * * * *

UNITED STATES PATENT AND TRADEMARK OFFICE

CERTIFICATE OF CORRECTION

PATENT NO. : 9,091,253 B2
APPLICATION NO. : 13/000103
DATED : July 28, 2015
INVENTOR(S) : Uwe Bernhard Pascal Stein et al.

It is certified that error appears in the above-identified patent and that said Letters Patent is hereby corrected as shown below:

On the title page item (73)
Please add the second applicant

--DANFOSS POWER SOLUTIONS APS NORDBORG, DENMARK --

Signed and Sealed this
Fifteenth Day of December, 2015

Michelle K. Lee

Michelle K. Lee
*Director of the United States Patent and Trademark Office*